United States Patent [19]

Shalders

[11] Patent Number: 4,944,365

[45] Date of Patent: Jul. 31, 1990

[54] SAFETY NET SYSTEM

[75] Inventor: Alan J. Shalders, Purdys, N.Y.

[73] Assignee: Universal Builders Supply, Inc., Mount Vernon, N.Y.

[21] Appl. No.: 388,580

[22] Filed: Aug. 1, 1989

[51] Int. Cl.[5] ..... E04G 21/32

[52] U.S. Cl. ..... 182/138; 182/82

[58] Field of Search ..... 182/137, 138, 139, 140, 182/82

[56] References Cited

U.S. PATENT DOCUMENTS

| | | |
|---|---|---|
| 2,450,595 | 10/1948 | Jones . |
| 2,687,863 | 8/1954 | Vogt et al. . |
| 3,533,487 | 10/1970 | Norin . |
| 3,603,428 | 9/1971 | Hanses . |
| 3,921,757 | 11/1975 | Kennedy . |
| 3,949,834 | 4/1976 | Nusbaum . |
| 4,074,791 | 2/1978 | Inman . |
| 4,119,176 | 10/1978 | Verdu . |
| 4,129,197 | 12/1978 | Preston . |
| 4,732,234 | 3/1988 | Brickman . |

FOREIGN PATENT DOCUMENTS

| | | |
|---|---|---|
| 3323878 | 1/1984 | Fed. Rep. of Germany . |
| 1152485 | 2/1957 | France . |
| 1435582 | 3/1966 | France . |
| 1490572 | 6/1967 | France . |
| 2278879 | 5/1974 | France . |
| 2490264 | 3/1982 | France . |
| 65656 | 11/1969 | German Democratic Rep. . |

OTHER PUBLICATIONS

"SINCO Handbook of Passive Fall Protection", SINCO Products Incorporated, 1985; p. 2, line 7 to p. 3, line 4.

*Primary Examiner*—Reinaldo P. Machado

*Attorney, Agent, or Firm*—Brumbaugh, Graves, Donohue & Raymond

[57] ABSTRACT

A safety net system for multi-story building construction includes a plurality of post assemblies spaced around the perimeter of the building, each with a horizontal shaft at its lower end pivoted to a bracket attached to a lower floor of the building, and a safety net suspended between the outer, free ends of the post assemblies end the adjacent upper floor of the building. The horizontal shaft at the inner end of each post assembly is received in annular bearings having inner and outer sleeves and an elastic core therebetween. The bearings are releasably clamped about the horizontal shaft to restrain the post assembly against rotation and lock it in an upright, stowed position or an inclined, deployed position. The resiliency of the elastic core permits limited, upward rotation of the post assembly to absorb shocks from falling debris.

24 Claims, 3 Drawing Sheets

SAFETY NET SYSTEM

BACKGROUND OF THE INVENTION

The present invention relates to a safety net system for construction sites to prevent injury caused by falling debris. More particularly, it relates to a safety net which is extended outwardly at the perimeter of a building or the like by a system of poles and brackets secured to the building.

In the construction of high-rise structures, particularly those in proximity to population centers, it is vital that a system be in place whereby passersby and workmen below will be protected from falling construction debris. In fact, the presence of such systems is required under the law of most municipalities. Typical systems in use today generally include a series of brackets secured to the perimeter of a lower constructed floor or support columns. Each bracket holds a pole which extends upward and outward from the building edge. A safety net, attached at one end to an upper floor, is draped and secured to the extending ends of the poles. The safety net system then in place is extended to catch and retain debris which may fall, roll or be blown off the building during the construction of higher floors.

One prior art system presently in use employs a rocker bracket assembly with a sleeve for receiving the pole. The sleeve is attached to a vertical plate at an approximately 45° angle, which plate abuts the floor edge when the pole is in the deployed position. Extending inward from the plate is a rocker arm mechanism rotatably secured to the floor plate via a bolt placed through a hole in the rocker unit and through a loop unit extending vertically from the floor plate. The rocker arm mechanism permits the system to be easily pulled inward during assembly and disassembly.

There are, however, potentially dangerous drawbacks to this system. First, the pole and bracket assembly is secured to the structure only by a single bolt. If heavy objects falls into the net, the downward force could possibly cause sufficient torsional strain on the rocker arm mechanism to shear off the retaining bolt.

Another potential danger lies in the rocker arm mechanism itself. Although the vertical plate abuts the floor edge ostensibly to prevent outward rotation of the net system, there is no mechanism to prevent inward rotation. High gusts of wind frequently act upon safety net systems, especially at the upper floors of multi-story buildings. The above-described prior art system is susceptible to a dangerous condition wherein the wind may blow the netting and hence the unrestrained pole-bracket assembly inward towards the building, thus leaving the system in a temporarily undeployed state. At the same time, this same wind may cause debris to blow over the sides of the building.

Another prior art system is disclosed in U.S. Pat. No. 3,949,834 to Nusbaum, in which a socket is rotatably secured to the lower-floor bracket via a single bolt. Before deployment, a single cross-bolt placed outward from the socket retains the socket and pole in the upright position within the bracket. To deploy the system, workmen must remove the cross-bolt, thus permitting the pole to extend outward until it rests against a stop. The cross-bolt is then placed in a second location inward of the first so as to retain the pole in the extended position, secured between the cross-bolt and the stop.

Deployment of this system requires a great deal of time and attention, as workmen must remove the nut and cross-bolt from the first position, allow for extension of the system, then insert and secure the cross-bolt through the holes in the second position. Furthermore, the danger of "shearing off" is also present here, as the torsional strain imparted by a falling object must be borne by a single retaining bolt.

A further drawback results from the rigid deployed state of the system. Under certain conditions, it is possible for a falling object to bounce out of the net owing to the lack of rotational "give" in the way in which the poles are fixed to the lower-floor brackets.

SUMMARY OF THE INVENTION

It is an object of the present invention to overcome the foregoing and other disadvantages of the prior art by providing a safety net system which is easy to install and deploy, as well as to disassemble and move to a higher floor.

It is a further object to provide a system which is able to withstand the load of falling debris without the risk of shearing off at its rotation point.

It is an additional object to provide a system which will remain effectively extended even under windy conditions, yet will be resilient enough to "give" under the stress of falling debris so that the debris will be retained within the safety netting.

These and other objects are attained, in accordance with the invention, by a safety net system for multi-story building construction including a plurality of post assemblies spaced around the perimeter of the building. Each post assembly carries a horizontal shaft at its lower end about which it is pivoted to a bracket attached to a lower floor of the building. A safety net is suspended between the outer, free ends of the post assemblies and the adjacent upper floor of the building. The horizontal shaft at the inner end of each post assembly is received in annular bearings having inner and outer sleeves and an elastic core therebetween. The bearings are releasably clamped about the horizontal shaft to restrain the post assembly against rotation and lock it in an upright, stowed position or an inclined, deployed position. The resiliency of the elastic core permits limited, upward rotation of the post assembly to absorb shocks from falling debris. If an object falls into the deployed netting, the pole will rotate in towards the structure, but will be restrained by the tight hold of the clamps around the bearings. At the same time, the impact of the rotation will be cushioned by the increasing torsional resistance of the elastic core of the bearings, thus insuring a soft landing for the falling object and preventing it from bouncing out of the netting.

The above-described arrangement also prevents the system from closing up during high gusts of wind, as the tight grip of the clamps upon the bearings will resist the force imparted to the poles via the blown netting and will keep the system deployed at this critical time.

A further advantage of the invention is that the clamp and bearing arrangement allows for a system adaptable for the differing needs which may arise during construction. For example, a slight loosening of the grip of the clamps around the bearings will allow for a controlled rotation of the poles so that the system may collapse in around a falling object.

BRIEF DESCRIPTION OF THE DRAWINGS

For a better understanding of the invention, reference may be made to the following description of a representative embodiment thereof and to the accompanying drawings, in which.

DETAILED DESCRIPTION

For purposes of illustration, a representative embodiment of the invention is described hereinbelow in the context of a high-rise construction site. It will be understood, however, that the invention is not limited to that particular use, but has general application to any situation in which safety netting is desirable.

Figure 1:
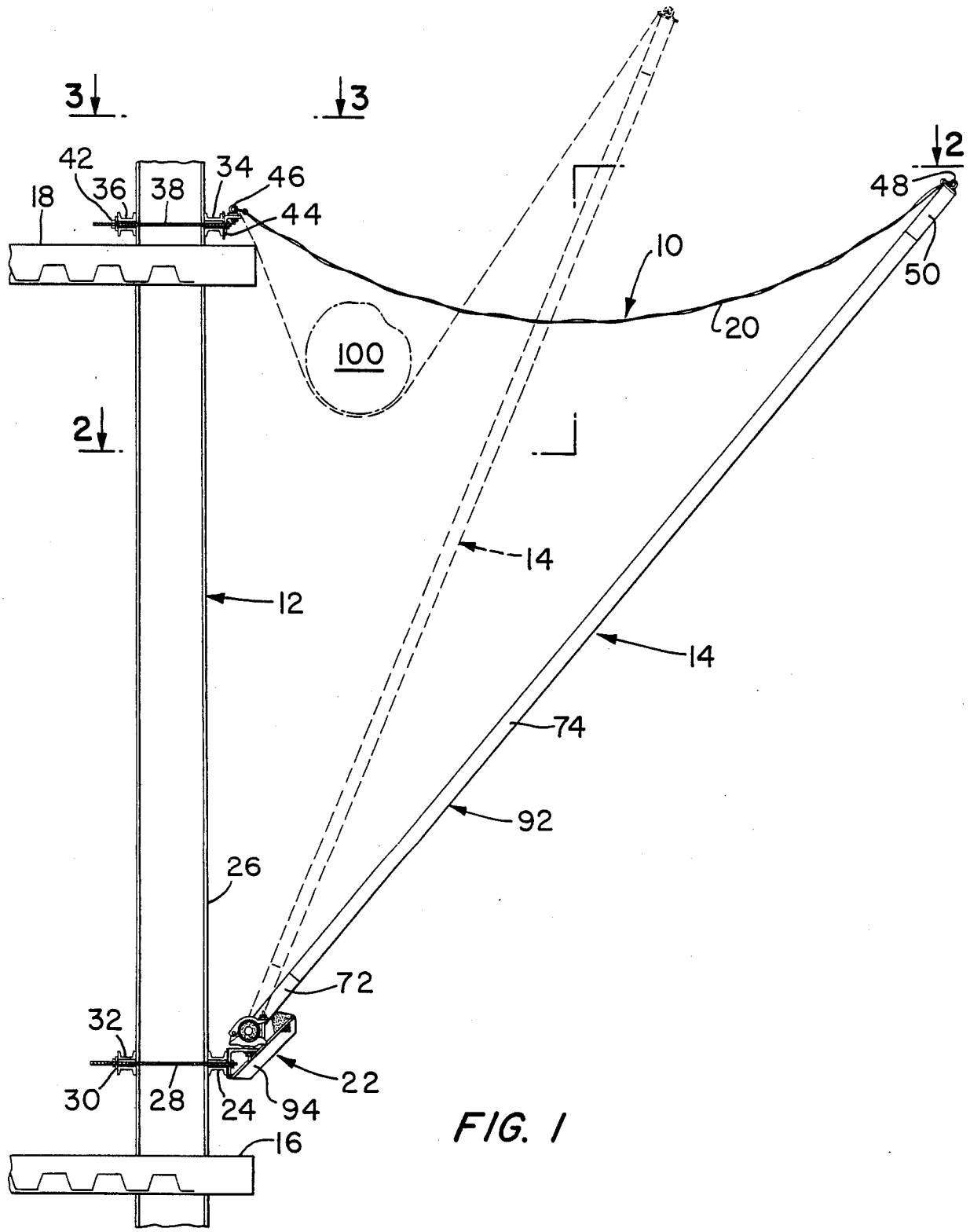
FIG. 1 is a side view of a safety net system embodying the invention, showing the system in the deployed position (solid lines) for improved retention of debris and a partially collapsed position (dashed lines), at which debris has been captured within the net.
Figure 2:
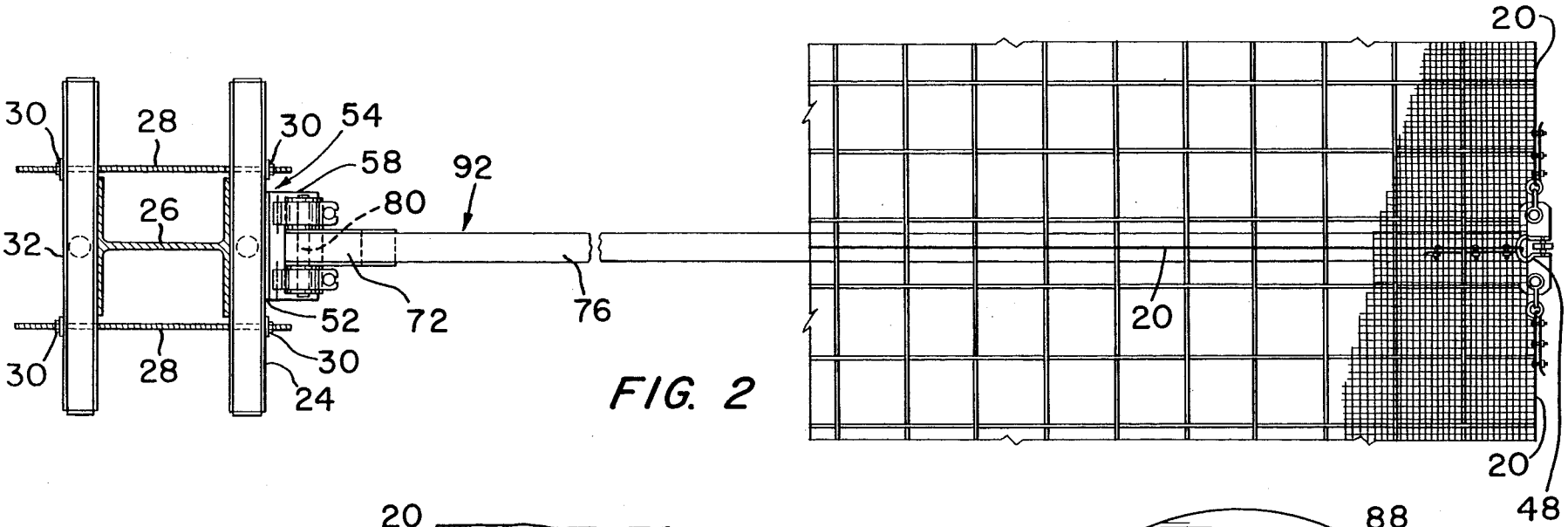
FIG. 2 is a partial horizontal sectional view taken along the line 2—2 of FIG. 1 in the direction of the arrows.
Figure 3:
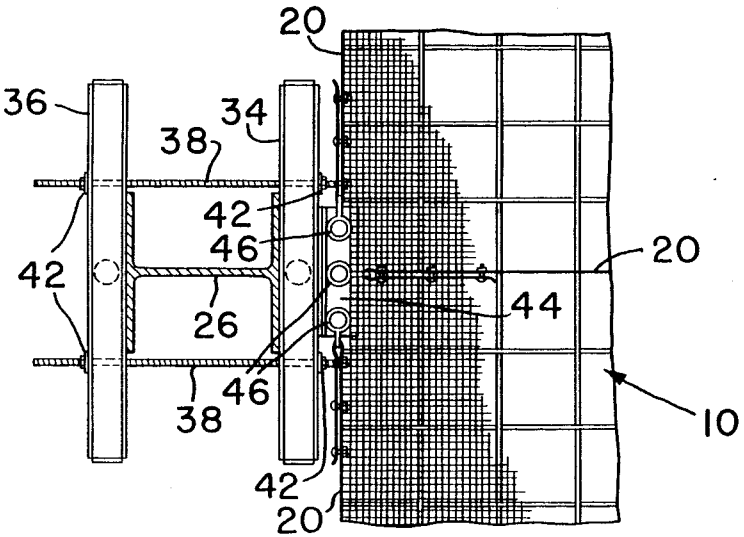
FIG. 3 is a top view of one embodiment of the upper floor netting attachment of the invention as shown in FIG. 1.

With reference to FIGS. 1–3, the safety net system of the present invention comprises a safety net 10 deployed around the perimeter of a multi-story building 12 under construction. Post assemblies 14 are mounted at various intervals around the perimeter of a lower floor 16 of the building. The inside edge of the safety net 10 is secured to the building near an upper floor 18, while the outside edge of the net 10 is secured via a netting cable 20 to the upper outer ends of the post assemblies 14. The post assemblies 14 extend pivotally outward from the structure during deployment, so that the outstretched safety net 10 may retain debris that may fall, roll or be blown off from the upper floors during construction.

Each post assembly 14 is pivotally attached at its inner, lower end to the building 12 by a mounting bracket assembly 22. In the embodiment of FIGS. 1–3, the mounting bracket assemblies 22 are bolted or otherwise secured to a cross bar 24, which may comprise a small H-beam. The H-beam is in turn clamped to the column 26 by a pair of threaded clamping bars 28, nuts 30, and a backing cross bar 32. (See FIG. 2). As best shown in FIG. 3, a similar arrangement of cross bars 34, 36, clamping bars 38 and nuts 42 is employed adjacent the upper floor 18 to secure the inner end of the net 10 to the column 26. For that purpose, an L-shaped bracket 44 is bolted or otherwise attached to the cross bar 34 and the net 10 is attached thereto by looping the netting cable 20 through U-bolts 46 fastened to the L-shaped bracket 44. (See FIG. 3).

The netting cable is interwoven with the net 10 for support around both the perimeter thereof and crosswise at points of attachment to the L-shaped bracket 44. The outer end of the net 10 is secured via the netting cable 20 to an eyelet 48 located on the end cap 50 of the post assemblies 14.

Figure 4A:
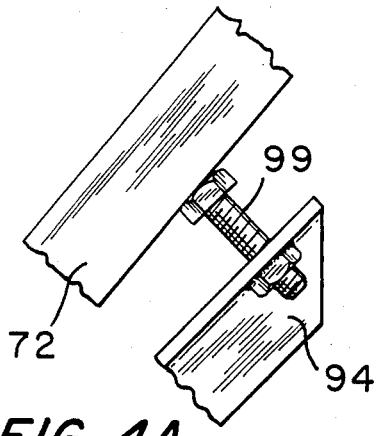
FIG. 4A is a partial side view of a second embodiment of the mounting bracket and associated post assembly.
Figure 4:
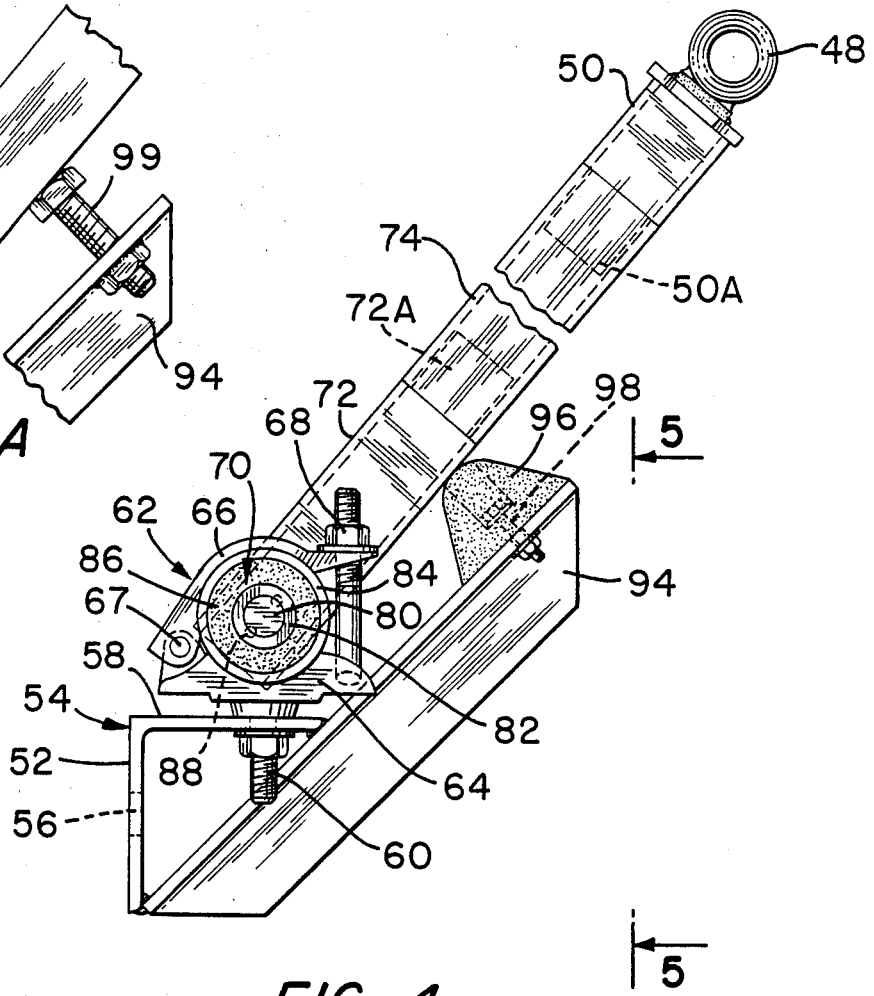
FIG. 4 is a side view of one embodiment of the mounting bracket and associated post assembly of the invention as shown in FIG. 1.
Figure 5A:
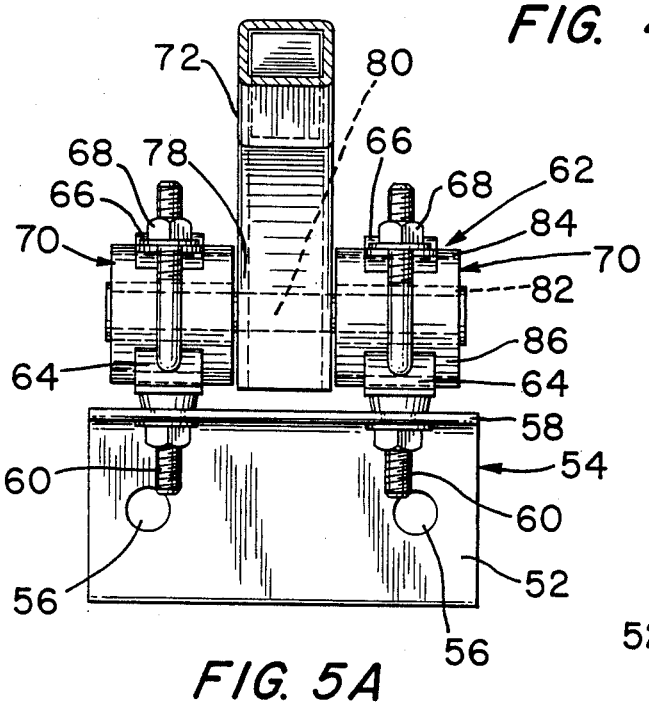
FIG. 5A is a partial frontal view of the mounting bracket and post assembly of FIG. 4, taken along the line 5-5 in the direction of the arrows but the deployed position stop assembly removed for clarity.

With reference to FIGS. 4 and 5, an embodiment of the mounting bracket assembly 22 of the invention will be described. The vertical leg 52 of an L-shaped mounting angle bracket 54 is bolted (through holes 56) or otherwise secured to the cross bar 24. Two standard scaffold clamps 62 are attached by threaded studs 60 to the leg 58 of the mounting angle bracket 54. The clamps 62 include a lower jaw member 64 attached to the upper end of the stud 60, an upper jaw member 66, which is pivoted to the lower jaw 66 about a pivot pin 67, and an adjustable bolt 68 bridging the members 64 and 66 for adjustably tightening the clamp 62 around an annular bearing 70 received therebetween. To that end, the facing surfaces of the lower and upper jaws 64 and 66 are curved to conform to the outer surface of the bearing 70. As shown in FIG. 5A, the clamps 62 are horizontally spaced apart by a distance sufficient for a post assembly 14 to be received therebetween with clearance for pivotal movement of the post assembly 14 relative to the clamps 62.

To facilitate adjustment of the length of the post assemblies 14 to suit the requirements of each construction site, each post assembly 14 is preferably fabricated in three segments: a short inner end segment 72, a long central segment 74, and a short outer segment or end cap 50 (see FIG. 4). As described hereinafter, the inner end segment 72 carries a horizontal shaft 80 and bearings 70 for cooperation with the clamps 62, while the outer end segment or end cap 50 carries the eyelet 48 for engagement with the netting cable 20. By making the inner and outer end segments 72 and 50, respectively, separable from the central segment 74, the overall length of the post assembly 14 may readily be changed by substituting a different central segment 74. Hence, there is no need to fabricate an entire post assembly 14, including the outer eyelet 48 and the inner horizontal shaft 80 and bearings 70, for each new length of post assembly desired.

To facilitate assembly and disassembly of the post assembly 14, the segments 72, 74 and 50 are preferably tubular, e.g. circular, square, rectangular, etc., in cross section and the mating ends of the inner and outer segments 72 and 50 are preferably formed with reduced size extensions 72A and 50A which are telescopically received in the mating ends of the central segment 74. If desired, set screws or the like (not shown) may be used to retain the end segments 72 and 50 securely connected to the central segment 74.

Figure 6:
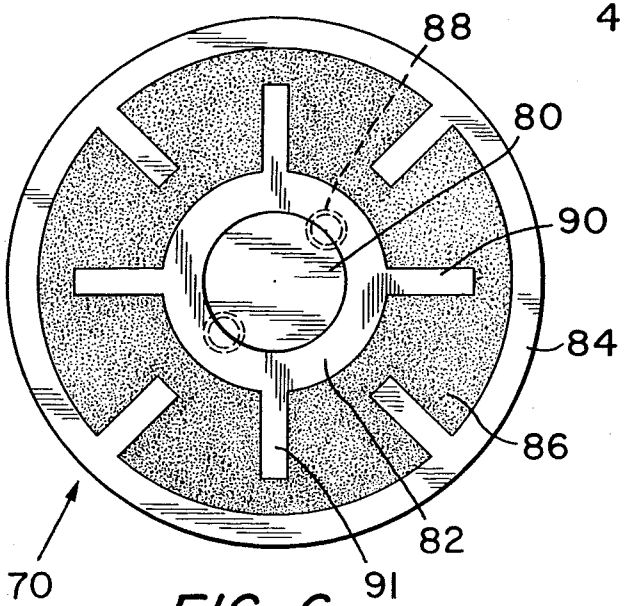
FIG. 6 is an enlarged side view of one embodiment of the bearing assembly with reinforcing fins.

Each inner end segment 72 has attached thereto adjacent its lower end 78, preferably by welding, a horizontal shaft 80 extending laterally therefrom to either side. The shaft 80 is preferably of sufficient length to extend through the clamps 62 on either side of the post end segment 72 (See FIG. 5A). Each end of the shaft 80 receives thereon an annular bearing 70, comprising an inner sleeve 82, an outer sleeve 84, and an elastic core 86 between the sleeves 82, 84. The tubular inner sleeve 82 fits over the shaft 80 and preferably is held against rotation about the shaft 80 by set screws 88 (See FIG. 6). The elastic core 86 is formed by pouring elastic material, preferably neoprene or other suitable rubber, in a liquid state and molding it in place between the two sleeves 82, 84, which are preferably of steel. For additional reinforcement of the core 86 against rotational shearing, a plurality of outward radial extensions 90 of the inner sleeve 82 may be provided, as shown in FIG. 6. Likewise, a plurality of inward radial projections 91 of the outer sleeve 84 may be provided in place of or in addition to outward projections 90. While depicted in FIG. 6 as generally rectangular in cross section and spaced at 90° intervals about the circumference of the inner and outer sleeves 82, 84, it will be understood that any suitable conformation and orientation of the extensions 90, 91 may be explored.

As shown in FIGS. 4 and 5A, the inner end segment 72 is secured to the mounting bracket assembly 22 via the bearings 70 which conformingly reside between the lower and upper jaw members 64, 66 of the spaced-apart scaffold clamps 62. The clamps 62 are tightened to the extent desired along the outer circumference of the outer sleeve 84 of the bearing assemblies 70 by way of the adjustable bolts 68. In this way, the post assembly 14 is held against rotation relative to the mounting bracket 22. Nonetheless, the resilience of the elastic cores 86 of the bearings 70 will permit limited rotation of the post assembly 14 to absorb shock loads due to falling debris 100. Also, the bracket assembly 22 preferably includes a rigid member 94 to define a positive stop for the post assembly 14 when in the deployed position.

Figure 5B:
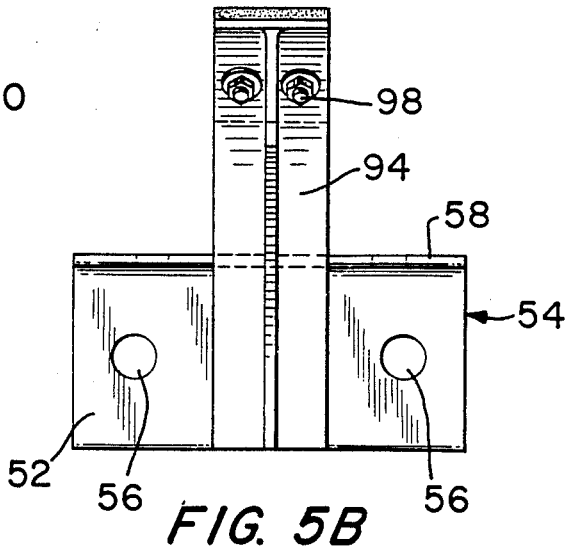
FIG. 5B is a partial frontal view of the mounting bracket of FIG. 4 showing the deployed position stop assembly in place on the bracket.

As shown in FIGS. 4 and 5B, the member 94 may take the form of an upwardly angled T-bar welded to the flanges of the angle bracket 54. A protruding bumper 96, preferably of resilient material, is attached to the upper end of the member 94 via a bolt assembly 98 or the like to cushion the contact between the post assembly 14 and the member 94. The angle of inclination of the post assemblies 14 in the deployed position is determined both by the inclination of the T-bar member 94 and by the size of the bumper 96.

As an alternative to the bumper 96 described above, FIG. 4A shows an adjustable bolt 99 which may be attached to the upper end of member 94 to act as a deployed-position stop for the post assemblies 14 and to adjustably determine the angle of inclination thereof. It will also be apparent that the above two embodiments may be combined to provide an adjustable resilient bumper.

With reference now to FIGS. 1–3, the operation of the system will be described. The mounting bracket assemblies 22, comprising the mounting angle bracket 54, scaffold clamps 62, bearings 70 and post end segment 72, are mounted at various intervals to the perimeter of a lower floor 16 of a structure 12 or, alternatively, to the outer faces of support columns 26 by a bar clamp unit or threaded receptacles in the floor slab. During installation, the post assemblies 14, with the netting 10 already attached to the outer end segments 50, are secured in the upright position by tightening th adjustable bolts 68 of the clamps 62. The inside edge of the netting 10 is then secured to an upper floor 18 or column 26 via the clamping assembly described above. To deploy the system, the adjustable bolts 68 are loosened to permit the bearings 70 to rotate within the clamps 62 about shaft 80, which acts as the pivot axis. The post assemblies 14 extend outwardly and rest against the bumpers 96 in the deployed position. The adjustable bolts 68 are then tightened to a degree reflecting the specific needs of the project, i.e. to provide the desired degree of resistance to upward and inward rotation of the post assemblies 14.

When an object 100 falls downward into the net 10, the post assembly 14 is pulled inward under the force of impact and the weight of the object (See FIG. 1). The post assembly 14 remains in the extended position, however, as the clamps 62 securely restrain the bearings 70 from inward rotation. While the rigidity of prior art systems under the impact of falling debris may allow for the bouncing out of such debris, the present invention provides a shock absorber effect which allows for a soft landing and improved retention of fallen debris in the netting 16. As inward rotational force is applied to the post assembly 14, the shaft 80 rotating therewith bears rotationally against the inner sleeve 82. Though the bearing 70 is tightly clamped and thus remains relatively static, the post assembly 14 does "give" somewhat as the resilient core 86 of the bearing 70 flexes elastically under the rotational pressure.

Furthermore, the secure retention of the system in the extended position is adequately maintained by the clamps 62 upon the bearings 70 so as to resist the inward force of wind gusts which tend to pull the net 10 and hence dangerously collapse the system at a time when it is most needed.

Another novel embodiment of the system for catching and retaining falling debris comprises a sliding brake means. Such sliding brake means permits a controlled and limited rotation of the system inward toward the structure upon receiving a falling object to the extent necessary to retain the object therein. While any and all mechanisms are contemplated which will achieve this effect, a preferred embodiment employs clamps 62 to allow for a controlled rotation of the system. The adjusting bolts 68 can be loosened accordingly so as to allow the system to rotate inward and collapse around a fallen object 100, thereby further preventing it from bouncing out. The degree of inward rotation permitted can be varied via the adjusting bolts 68, and should be done while taking into consideration the weight of expected falling debris and the force of gusting winds to be resisted.

In addition to the demonstrated ease of assembly, the invention also resides in its ease of disassembly, which is an important factor in the upward construction of high-rise buildings. The entire system may be temporarily collapsed to allow for crane movement by simply loosening the adjusting bolts 68 and pulling the post assemblies 14 inward. At this point, complete disassembly is easily accomplished by reversing the assembly steps described above.

Although the invention has been described and illustrated by reference to a specific embodiment thereof, it will be understood that such embodiment is susceptible to modification and variation without departing from the inventive concepts disclosed. For example, instead of the dual bearing and clamp configuration described above, the inner end segment 72 may be fork-shaped with the shaft 80 extending between the forks for receiving a single bearing assembly 70 and clamp unit 62. All such modifications, and variations, therefore, are intended to be included within the spirit and scope of the appended claims.

I claim:

1. A safety net system for capturing falling debris at a construction site, comprising:

a plurality of mounting brackets attached to a lower level of a structure under construction at spaced locations around the perimeter thereof;

a corresponding plurality of elongate post assemblies, each having a horizontally extending shaft attached thereto adjacent a first, inner end thereof;

annular bearing means carried by the horizontal shaft of each post assembly;

adjustable clamping means carried by each mounting bracket for releasably clamping the annular bearing means carried by said corresponding post assembly to restrain said post assembly against vertical rotation, whereby said post assembly may be rotated between and clamped at an upright, stowed position and an inclined, deployed position;

each mounting bracket further including means defining a deployed-position stop for the corresponding post assembly; and a safety net suspended between the second, outer ends of said plurality of post assemblies and an upper level of the structure.

2. The safety net system of claim 1 wherein said annular bearing means comprises an inner sleeve secured to said horizontal shaft against rotation relative thereto, an outer sleeve, and an elastic core interposed between said inner and outer sleeves, said elastic core permitting limited pivotal movement of said corresponding pole assembly to absorb loads.

3. The safety net system of claim 1 wherein:

said horizontal shaft extends on both sides of said pole assembly;

said annular bearing means comprises a pair of horizontally spaced annular bearing units, one each on either side of said first, inner end of the corresponding pole assembly, for receipt of the shaft portion extending on the corresponding side of the pole assembly;

said adjustable clamping means comprises a pair of horizontally spaced adjustable clamping units, one on either side of said first, inner end of the pole assembly, for clamping engagement with the bearing unit on the corresponding side of the post assembly.

4. The safety net system of claim 1 wherein said adjustable clamping means further comprises an adjusting means for selectively adjusting the tightness of the engagement of said bearing unit with said clamping units so that a controlled rotation of the system may be permitted whereby the system rotates inward toward said structure to collapse around and retain an object falling into said safety net.

5. The safety net system of claim 1 further comprising means attached to each mounting bracket and extending outwardly and upwardly therefrom for defining a deployed-position stop for the corresponding post assembly.

6. The safety net system of claim 5 wherein said stop-defining means comprises a resilient member adjacent the outer end thereof against which the corresponding post assembly rests when in the deployed position.

7. The safety net system of claim 5 wherein said stop-defining means comprises an adjustable bolt secured to the mounting bracket against the end of which the corresponding post assembly rests when in the deployed position.

8. The safety net system of claim 1 wherein each post assembly comprises:

a relatively short first inner end segment having said horizontal shaft attached thereto; and a second, relatively long outer segment releasably attached to the outer end of said inner segment.

9. The safety net system of claim 8 wherein said outer segment further comprises a third, relatively short outer end segment releasably attached to the outer end of said second segment, said outer end segment including means for attaching the safety net thereto.

10. The safety net system of claim 9 wherein said first, second and third segments are tubular in cross section and said second segment is telescopically connected at its inner and outer ends to said first and third segments, respectively.

11. A subassembly for a safety net system for capturing falling debris at a construction site, comprising:

a mounting bracket attached to the lower level of a structure under construction at a location on the perimeter thereof;

an elongate post assembly, having a horizontally extending shaft attached thereto adjacent a first, inner end thereof;

annular bearing means carried by the horizontal shaft of the post assembly;

adjustable clamping means carried by the mounting bracket for releasably clamping the annular bearing means carried by said post assembly to restrain said post assembly against vertical rotation, whereby said post assembly may be rotated between and clamped at an upright, stowed position and an inclined deployed position; and the mounting bracket further including means defining a deployed-position stop for the post assembly;

whereby a safety net may be suspended between the second, outer end of said post assembly and an upper level of the structure.

12. The subassembly of claim 11, wherein said annular bearing means comprises an inner sleeve secured to said horizontal shaft against rotation relative thereto, an outer sleeve, and an elastic core interposed between said inner and outer sleeves, said elastic core permitting limited pivotal movement of said pole assembly to absorb loads.

13. The subassembly of claim 11, wherein said horizontal shaft extends on both sides of said pole assembly;

said annular bearing means comprises a pair of horizontally spaced annular bearing units, one each on either side of said first, inner end of the post assembly, for receipt of the shaft portion extending on the corresponding side of the post assembly;

said adjustable clamping means comprising a pair of horizontally spaced adjustable clamping units, one on either side of said first, inner end of the post assembly, for clamping engagement with the bearing unit on the corresponding side of the post assembly.

14. The subassembly of claim 11, wherein said adjustable clamping means further comprises an adjusting means for selectively adjusting the tightness of the engagement of said bearing unit with said clamping units so that a controlled rotation of the system may be permitted whereby the system rotates inward toward said structure to collapse around and retain an object falling into said safety net.

15. The subassembly of claim 11, further comprising means attached to the mounting bracket and extending outwardly and upwardly therefrom for defining a deployed position stop for the post assembly.

16. The subassembly of claim 15, wherein said stop-defining means comprises a resilient member adjacent the outer end thereof against which the post assembly rests when in the deployed position.

17. The subassembly of claim 15 wherein said stop-defining means comprises an adjustable bolt secured to the mounting bracket against the end of which the corresponding post assembly rests when in the deployed position.

18. The subassembly of claim 11, wherein the post assembly comprises:

a relatively short first inner end segment having said horizontal shaft attached thereto; and a second, relatively long outer segment releasably attached to the outer end of said inner segment.

19. The subassembly of claim 18, wherein said outer segment further comprises a third, relatively short outer end segment releasably attached to the outer end of said second segment, said outer end segment including means for attaching the safety net thereto.

20. The subassembly of claim 19, wherein said first, second and third segments are tubular in cross section and said second segment is telescopically connected at its inner and outer ends to said first and third segments, respectively.

21. A safety net system for capturing falling debris at a construction site, comprising:

a plurality of mounting brackets attached to a lower level of a structure under construction at spaced locations around the perimeter thereof;

a corresponding plurality of elongate post assemblies pivotally attached at first, inner ends thereof to said mounting brackets, whereby said post assemblies may be controllably rotated between and secured at an upright, stowed position and an inclined, deployed position;

adjusting means for selectively adjusting the degree of controlled rotation permitted by said post assemblies whereby the system rotates inward toward said structure to collapse around and retain an object falling into said safety net;

each mounting bracket further including means defining a deployed position stop for the corresponding post assembly; and a safety net suspended between the second, outer ends of said plurality of post assemblies and an upper level of the structure.

22. The safety net system of claim 21, further comprising:

a horizontally extending shaft attached to each post assembly adjacent the first, inner end thereof;

annular bearing means carried by the horizontal shaft of each post assembly; and adjustable clamping means carried by each mounting bracket for releasably clamping the annular bearing means carried by said corresponding post assembly to controllably restrain said post assembly against vertical rotation.

23. A subassembly for a safety net system for capturing falling debris at a construction site comprising:

a plurality of mounting brackets attached to a lower level of a structure under construction at spaced locations around the perimeter thereof;

a corresponding plurality of elongate post assemblies pivotally attached at first, inner ends thereof to said mounting brackets, whereby said post assemblies may be controllably rotated between and secured at an upright, stowed position and an inclined, deployed position;

adjusting means for selectively adjusting the degree of controlled rotation permitted by said post assemblies whereby the system rotates inward toward said structure to collapse around and retain an object falling into said safety net;

each mounting bracket further including means defining a deployed position stop for the corresponding post assembly; and a safety net suspended between the second, outer ends of said plurality of post assemblies and an upper level of the structure.

24. A subassembly of claim 23, further comprising:

a horizontally extending shaft attached to each post assembly adjacent the first, inner end thereof;

annular bearing means carried by the horizontal shaft of each post assembly; and adjustable clamping means carried by each mounting bracket for releasably clamping the annular bearing means carried by said corresponding post assembly to controllably restrain said post assembly against vertical rotation.

* * * * *